US010495312B2

(12) United States Patent
Rodrigues et al.

(10) Patent No.: US 10,495,312 B2
(45) Date of Patent: Dec. 3, 2019

(54) SEALING DEVICE BETWEEN AN INJECTION SYSTEM AND A FUEL INJECTION NOZZLE OF AN AIRCRAFT TURBINE ENGINE

(71) Applicant: SAFRAN AIRCRAFT ENGINES, Paris (FR)

(72) Inventors: Jose Roland Rodrigues, Nandy (FR); Christophe Chabaille, Levallois Perret (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 22 days.

(21) Appl. No.: 15/544,175

(22) PCT Filed: Jan. 18, 2016

(86) PCT No.: PCT/FR2016/050084
§ 371 (c)(1),
(2) Date: Jul. 17, 2017

(87) PCT Pub. No.: WO2016/116686
PCT Pub. Date: Jul. 28, 2016

(65) Prior Publication Data

US 2018/0003385 A1 Jan. 4, 2018

(30) Foreign Application Priority Data

Jan. 19, 2015 (FR) ..... 15 50399

(51) Int. Cl.
*F23R 3/28* (2006.01)
*F23D 11/38* (2006.01)
(Continued)

(52) U.S. Cl.
CPC ..... *F23R 3/283* (2013.01); *F23D 11/383* (2013.01); *F23R 3/14* (2013.01); *F23R 3/26* (2013.01);
(Continued)

(58) Field of Classification Search
CPC .... F23R 2900/0012; F23R 3/283; F02C 7/20; F02C 7/28; F05D 2240/55
See application file for complete search history.

(56) References Cited

U.S. PATENT DOCUMENTS 3,853,273 A 12/1974 Bahr et al.
4,693,074 A * 9/1987 Pidcock ..... F23C 3/00 60/740
(Continued)

FOREIGN PATENT DOCUMENTS

EP 1 731 837 A2 12/2006
FR 2 970 551 A1 7/2012
(Continued)

OTHER PUBLICATIONS

International Search Report dated Apr. 26, 2016 in PCT/FR2016/050084 filed Jan. 18, 2016.
(Continued)

*Primary Examiner* — Steven M Sutherland
(74) *Attorney, Agent, or Firm* — Oblon, McClelland, Maier & Neustadt, L.L.P.

(57) ABSTRACT

An arrangement for an aircraft turbine engine combustion chamber including an injection system and a fuel injector is provided. The injection system includes an injector nozzle guide, the inner surface of which delimits an opening for centering the nozzle, which includes an outer casing. The arrangement further includes a sealing device between the inner surface of the guide and the outer casing. The sealing device includes a first part accommodated in a groove of the
(Continued)

outer casing, the groove being delimited, in part, by a downstream delimiting surface, the first part having a first sealing surface and bearing axially against the downstream delimiting surface; and a second part having a second sealing surface bearing radially against the inner surface of the guide.

9 Claims, 5 Drawing Sheets

(51) Int. Cl.
*F23R 3/14* (2006.01)
*F23R 3/26* (2006.01)

(52) U.S. Cl.
CPC ..... *F23R 3/286* (2013.01); *F05D 2240/55* (2013.01); *F23R 2900/00012* (2013.01)

(56) References Cited

U.S. PATENT DOCUMENTS 4,712,370 A * 12/1987 MacGee ..... F01D 21/003 277/345
5,222,358 A * 6/1993 Chaput ..... F23R 3/283 60/740
5,328,101 A * 7/1994 Munshi ..... F16L 13/14 239/600
5,344,162 A 9/1994 Kernon et al.
6,250,062 B1 6/2001 Lawen, Jr. et al.
7,415,828 B2 * 8/2008 Brown ..... F23R 3/60 60/740
2005/0223713 A1 10/2005 Ziminsky et al.
2006/0288706 A1 12/2006 Ziminsky et al.
2010/0031669 A1 * 2/2010 Ensign ..... F02C 3/10 60/784
2011/0162359 A1 7/2011 Bochud et al.
2012/0195743 A1 8/2012 Walunj et al.
2014/0318148 A1 * 10/2014 Clemen ..... F02C 7/28 60/796

FOREIGN PATENT DOCUMENTS

FR 2 987 428 A1 8/2013
FR 2 993 347 A1 1/2014

OTHER PUBLICATIONS

French Search Report dated Nov. 19, 2015 in French Application 1550399 filed Jan. 19, 2015.
U.S. Appl. No. 14/772,924, filed Sep. 4, 2015, US 2016/0017808 A1, Christophe Chabaille et al.

* cited by examiner

SEALING DEVICE BETWEEN AN INJECTION SYSTEM AND A FUEL INJECTION NOZZLE OF AN AIRCRAFT TURBINE ENGINE

TECHNICAL DOMAIN

The invention relates to the domain of combustion chambers for aircraft turbine engines. More specifically, the invention relates to fuel injectors and injection systems to inject an air-fuel mix for such turbine engine combustion chambers.

STATE OF PRIOR ART

A classical injection system of an air-fuel mix into an aircraft turbine engine combustion chamber is known for example through document EP 1 731 837 A2.

The injection system comprises a part fixed relative to the combustion chamber. The fixed part comprises a mixer bowl fixed to a combustion chamber bottom, and a venturi and an air swirler. The venturi and the air swirler are located upstream from the mixer bowl.

The injection system also comprises a sliding cross member free to move relative to the fixed part. The sliding cross-member, also called the "injection nozzle guide", is configured to mechanically connect the fuel injector to the injection system. This guide is intended particularly to at least partially compensate for misalignments of the injector relative to the injection system during operation and/or during assembly of the injector and the injection system in the combustion chamber.

The guide has an inner surface delimiting a centring orifice in which the injector nozzle is centred. The nozzle comprises an outer casing centred on a longitudinal axis of the injector nozzle. The guide and the outer casing of the injector nozzle are thus subject to wear at their contact surface, corresponding to said inner surface of the guide. This wear is generated particularly by engine vibrations and is aggravated by misalignments of the injector relative to the injection system.

An undesirable clearance is then created between the guide and the injector nozzle during the life of the installation. The main consequence of this clearance is the generation of an additional uncontrolled air flow towards the bottom of the combustion chamber. In general, the result is a reduction in the performances of the combustion chamber. This unwanted air flow could create important disturbances to operation of the combustion chamber, particularly in terms of flame stability, risk of flameout of the chamber or the in-flight reignition capability.

Furthermore, excessive wear can make major repairs to the injector nozzle necessary, such as replacement of its outer casing, with a non-negligible impact on the global cost of the solution.

SUMMARY OF THE INVENTION

The invention is aimed at at least partially solving problems encountered in solutions according to prior art.

To achieve this, the first subject of the invention is an arrangement for an aircraft turbine engine combustion chamber, the arrangement comprising a system for injection of an air-fuel mix into the combustion chamber, and a fuel injector, comprising a spray nozzle, the injection system comprising a spray nozzle guide, the inner surface of which delimits a centring opening in which there is the injector nozzle that is composed of an outer casing centred on a longitudinal axis of the injector nozzle.

According to the invention, the arrangement also comprises a sealing device between the inner surface of the guide and the outer casing of the injector nozzle, the sealing device comprising:

- a first part accommodated in a groove in the outer casing, said groove extending around said longitudinal axis and being delimited partly by a downstream delimiting surface, the first part having a first sealing surface and bearing axially against said downstream delimiting surface of the groove; and
- a second part having a second sealing surface bearing radially against said inner surface of the injector nozzle guide.

Therefore the invention has the special feature that a sealing device is implanted between the injector nozzle and the guide, to avoid/limit risks of generation of an additional air flow towards the bottom of the combustion chamber. In general, the result is an increase in the performances and life of the combustion chamber.

This sealing device limits wear between the guide and the injector nozzle, and can judiciously be used as a wear indicator to avoid extensive operations to repair the injector nozzle necessary with solutions according to prior art. Since a clearance is preferably provided between the outer casing of the injector nozzle and the inside surface of the guide, the sealing device specific to the invention will be consumed in priority, like a sacrificial part acting as a wear meter. It can thus be easily replaced before excessive damage occurs to the injector nozzle.

Finally, note that the solution proposed by the invention is particularly advantageous because the mass of the sealing device can be negligible.

The invention also preferably has at least one of the following additional characteristics, taken in isolation or in combination.

Said first and second parts of the sealing device are arranged to be approximately orthogonal with a connecting radius between the two, said second part extending backwards in the axial direction from said connecting radius. Preferably, the first and second parts are made from a single piece. The orthogonal layout between these two parts of the sealing device can advantageously form a hollow in which air under pressure from the compressor unit applies combined axial and radial pressure reinforcing contact forces at said first and second sealing surfaces of the sealing device.

Said second part comprises an upstream axial end and a downstream axial end located at the connecting radius, said upstream axial end being folded radially inwards. Such an annular fold makes it easier to extract the sealing device in the upstream direction, using an appropriate tool.

Said sealing device is in the form of a global split ring. The slit in the ring is preferably straight and is inclined relative to an axis of this ring. This causes rotation of the air leak generated by the slit in the ring. The direction of rotation and the angle are thus chosen so as to optimise integration into the air flow in the combustion chamber.

Said groove is partly delimited by an upstream delimiting surface facing said downstream delimiting surface, and the upstream delimiting surface extends radially outwards from an inner end of the first part of the sealing device. This arrangement limits risks that the sealing device might escape from its groove during insertion of the injector nozzle into the guide. The device can then be retained by the stop at the inner end of the first part of the sealing device, in contact with the upstream delimiting surface of the groove.

The sealing device is preferably metallic, and preferably has approximately constant thickness.

Said outer casing of the injection nozzle has a globally spherical outer surface, in other words its shape is conventional.

Another purpose of the invention is an aircraft turbine engine comprising at least one such arrangement.

Finally, the purpose of the invention is a method of assembling such an arrangement, including the following steps:

- placement of the sealing device in the groove formed on the outer casing of the injector nozzle;
- insertion of the injector nozzle fitted with the sealing device in the centring opening, by movement of the nozzle along the direction of its longitudinal axis.

Other advantages and characteristics of the invention will appear in the non-limitative detailed description given below.

BRIEF DESCRIPTION OF THE DRAWINGS

The invention will be better understood after reading the description of example embodiments, given purely for information and in no way limitative, with reference to the appended drawings on which.

DETAILED DESCRIPTION OF PARTICULAR EMBODIMENTS

Figure 1:
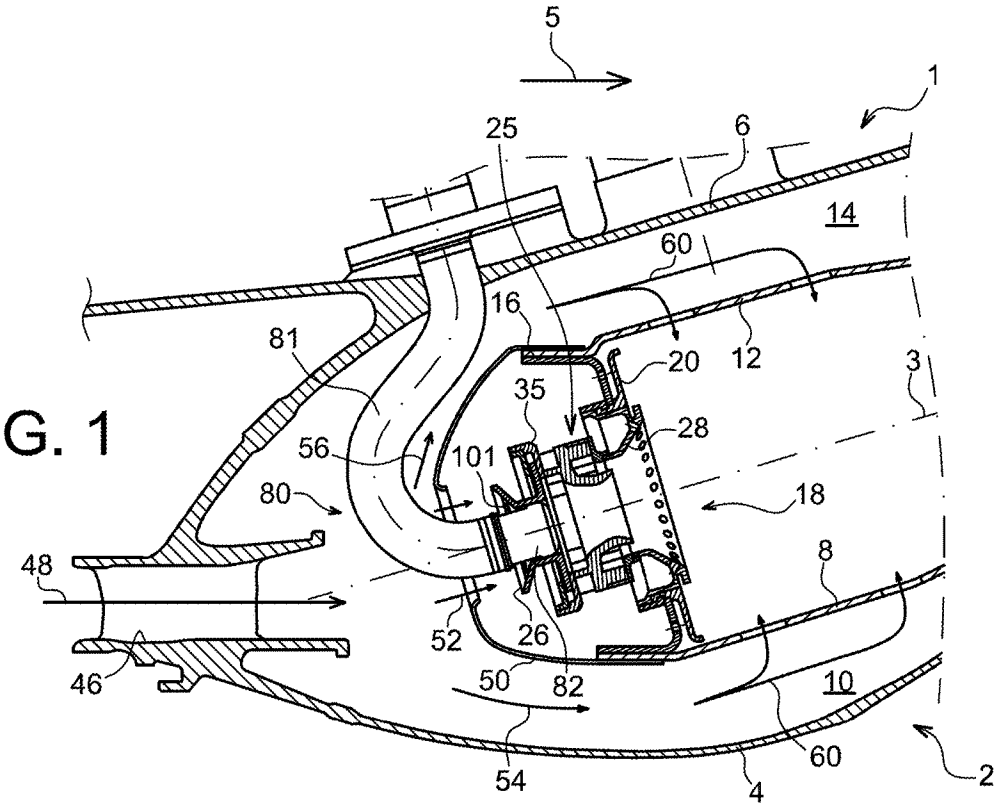
FIG. 1 shows a partial diagrammatic longitudinal half-sectional view of a combustion chamber for a turbine engine, including an arrangement according to a preferred embodiment of the invention.

FIG. 1 diagrammatically represents a combustion chamber 2 of an aircraft turbine engine 1, that is annular in shape about an axis of the turbine engine. The combustion chamber 2 comprises a fixed inner casing wall 4 and an outer casing wall 6. The outer casing wall 6 and an outer chamber wall 12 delimit an air flow passage 14. The inner casing wall 4 and an inner chamber wall 8 delimit a second air flow passage 10. The inner chamber wall 8 and the outer chamber wall 12 are connected through the chamber bottom 16 of the combustion chamber 2.

Throughout this document, the "upstream" and "downstream" directions are defined with regard to the general direction of air and fuel flow in the combustion chamber 2, diagrammatically represented by the arrow 5. This direction also corresponds approximately to the flow direction of exhaust gases in the turbine engine 1.

A plurality of injection systems 18 are fitted on the chamber bottom 16, only one of which is visible on FIG. 1. The injection system 18 comprises a sliding crossing 26, also called the "injector nozzle guide" and also includes a fixed downstream part 25 of the injection system 18. The injection system 18 is connected to a fuel injector 80 that is installed in the guide 26 at an injector nozzle 82.

Figure 2:
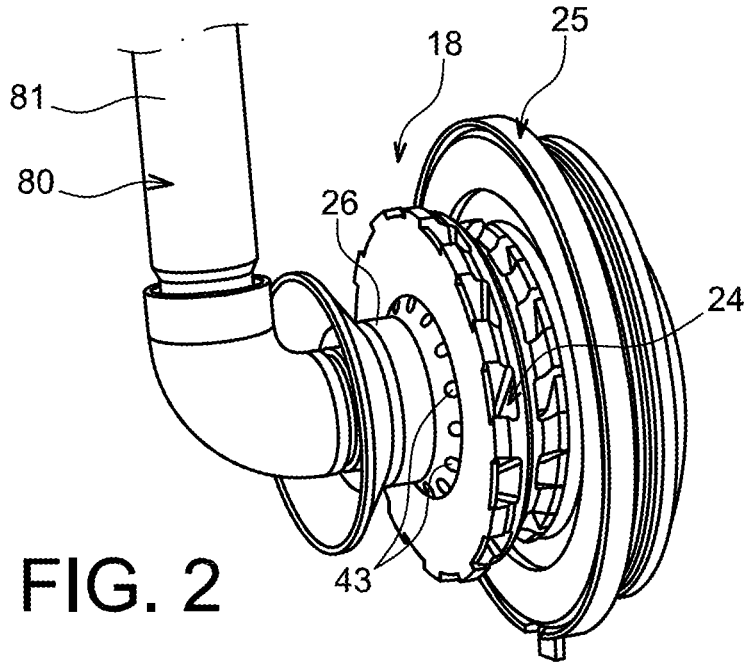
FIG. 2 shows a perspective view of the arrangement shown on the previous figure.
Figure 3:
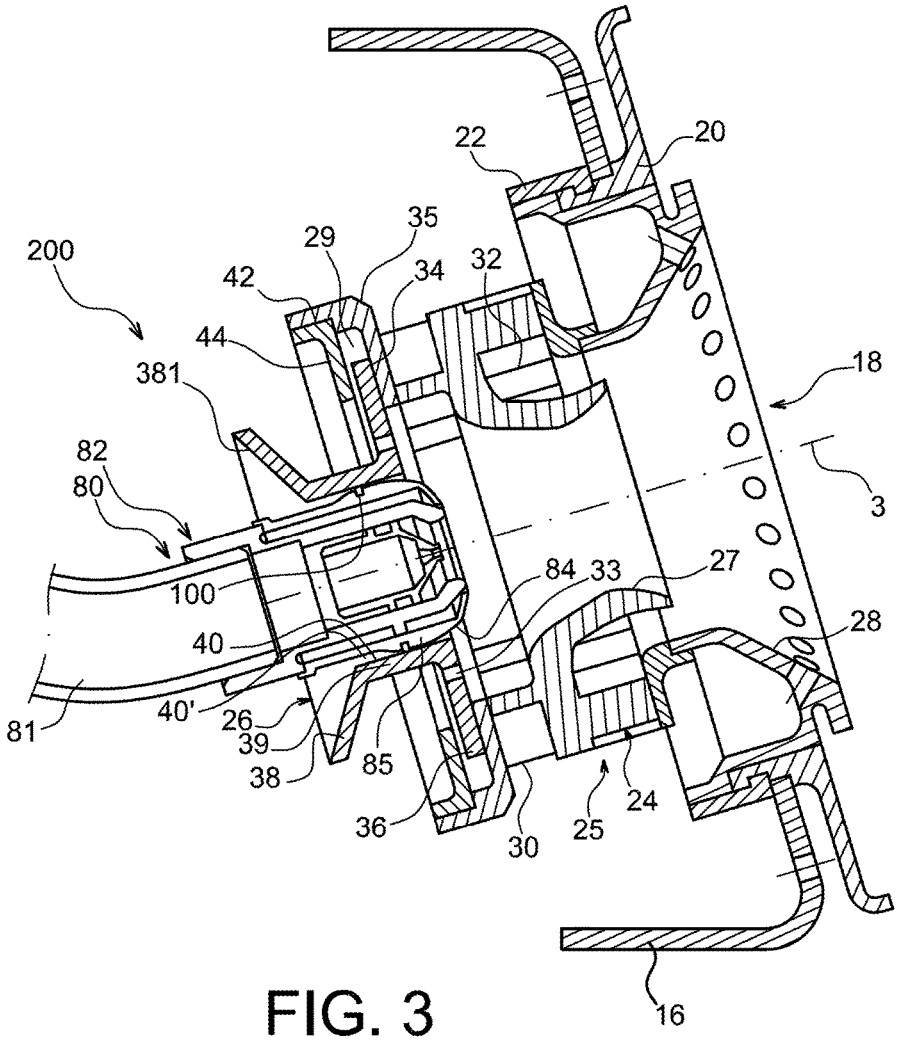
FIG. 3 shows a longitudinal sectional view of the arrangement shown on the previous figure.

With reference to FIGS. 1 to 3, the fixed downstream part 25 of the injection system 18 comprises a venturi 27, a swirler 24 and a mixer bowl 28 fixed to the chamber bottom 16. The fixed downstream part 25 is generally symmetrical in revolution about an axis 3 of revolution of the mixer bowl 28. The axis 3 of revolution of the mixer bowl 28 is usually coincident with the axis of revolution 3 of the injection system 18, and particularly with that of the guide 26. This axis 3 also corresponds to the longitudinal axis of the injector nozzle 82.

The swirler 24 is mounted fixed to the mixer bowl 28. It comprises a first stage of blades 30 and a second stage of blades 32 that have the function of driving air in rotation about the axis 3 of the mixer bowl 28. The blades in the first stage of blades 30 can rotate in the same direction as the blades in the second stage of blades 32, or in the opposite direction.

The mixer bowl 28 is tapered in an approximate shape of revolution about the axis 3 of the mixer bowl 28. It is connected to the bottom of the chamber 16 through a split ring 22 and possibly a deflector 20.

The guide 26 is free to move relative to the fixed downstream part 25 of the injection system 18. More precisely, the guide 26 is mounted free to slide on a housing ring 35 of the fixed downstream part 25.

The housing ring 35 comprises a wall 34 in contact with which the guide 26 can slide. The wall 34, in cooperation with an edge 44 of the fixed downstream part 25 of the injection system 18, defines a housing 29 for the sliding crossing shoe 36. The wall 34 and the edge 44 can possibly be monoblock, so as to form a single part.

The guide 26 is annular around the longitudinal axis 3. It comprises a shoe 36 configured to bear in contact with the fixed downstream part 25, and a tapered precentring portion 38 designed to precentre a fuel injector 80 such that the injector nozzle 82 can be subsequently be housed in the centring portion 39 of the guide 26. For example, the general shape of the precentring portion 38 is tapered. It opens up in the centring portion 39 that has a cylindrical inner surface 40 with centre line 3, delimiting a centring opening 40' in which the injector nozzle will be housed.

The guide 26 is preferably monoblock, such that the precentring portion 38, the shoe 36 and the centring portion 39 only form a single part.

The guide 26 comprises purge holes 33 distributed circumferentially close to the junction of the shoe 36 and the centring portion 39, these holes being used to introduce a bleed air flow into the injection system 18. The function of the bleed air flow is to prevent fuel from stagnating around the injector nozzle 82.

The injector nozzle 82 is located at the end of the injector body 81, at the annular terminal part of the injector 80, that has an aeromechanical or aerodynamic type design. The injector nozzle 82 comprises an outer casing 85 centred on the axis 3 and with a globally spherical shaped outer centring surface 84 and more precisely defining a segment in the shape of a sphere.

An operating clearance is preferably selected between the inner surface 40 defining the centring opening 40', and the outer centring surface 84 of the injector nozzle 82. The mechanical connection between the guide 26 and the injector nozzle 82 at least partially compensates for misalignments, caused particularly by manufacturing tolerances for the injector 80 and the injection system 18, assembly tolerances of the injector 80 and the injection system 18 in the combustion chamber 2, and differential expansions of the injector 80 relative to the injection system 18.

During operation, the combustion chamber 2, and particularly each injection system 18, are supplied in the direction of the arrow 48 by air under pressure at the passage 46. This air under pressure from the compressor unit arranged on the upstream side is used for combustion or cooling of the combustion chamber 2. Part of this air is added into the combustion chamber 2 at the central opening of a cover 50 as shown diagrammatically by the arrow 52, while another part of the air flows to the air flow passages 10 and 14 along directions 54 and 56 respectively and then along direction 60. The air flow shown diagrammatically by the arrows 60 then penetrates into the combustion chamber 2 through primary openings and dilution openings.

It is required to minimise the air flow between the inner surface 40 defining the centring opening 40', and the outer centring surface 84 of the injector nozzle 82. This parasite air flow could generate important disturbances to the operation of the combustion chamber, particularly in terms of flame stability, risk of flameout of the chamber and the in-flight reignition capability. This parasite air flow is limited by construction, due to the small operating clearance between the guide 26 and the injector nozzle 82. Nevertheless, if there is any wear of these parts, the clearance could increase and therefore reinforce the parasite air flow. To prevent this situation, the invention ingeniously includes the insertion of a sealing device 100 between the injector nozzle 82 and its guide 26, this device 100 being assembled on the outer casing 85 of the nozzle 82, as shown on FIG. 4.

Figure 5:
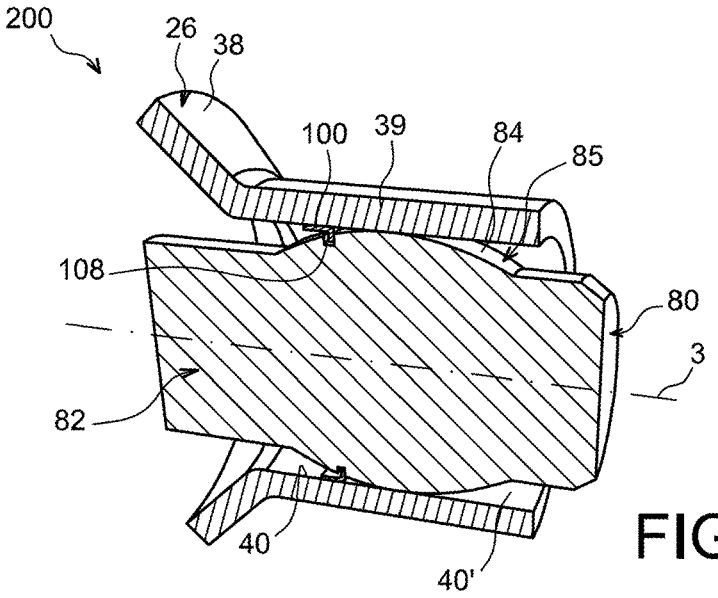
FIG. 5 shows an enlarged perspective view of part of the arrangement shown on the previous figure.
Figure 6:
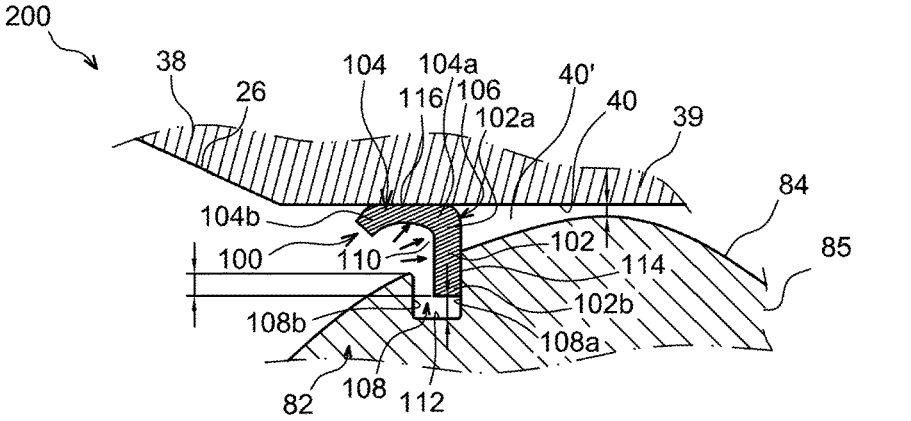
FIG. 6 shows a longitudinal sectional view of the part of the arrangement shown on the previous figure.

We will now describe this metallic sealing device 100 in more detail with reference to FIGS. 5 and 6, designed to resist the high ambient temperatures close to the combustion chamber.

The device 100 is annular in shape, centred on axis 3. It globally corresponds to a split ring to enable easy assembly on the outer casing 85 of the injector nozzle 82. It is made in a single piece, preferably with an approximately constant thickness. It comprises essentially two parts 102, 104, each in the form of an annular band, these parts 102, 104 being connected to each other through a connecting radius 106. The two parts 102, 104 are arranged approximately orthogonal to each other, the first 102 extending in the radial direction while the second 104 extends in the axial direction. More precisely, the first part 102 of the device 100 comprises an outer end 102*a* and an inner end 102*b* housed in a groove 108. The second part 104 has a downstream axial end 104*a* and an upstream axial end 104*b*. The ends 102*a*, 104*a* are connected through the connecting radius 106, such that the second part 104 of the device extends in the axially backwards direction from this connecting radius. The half-sections of the first and second parts 102, 104 thus form a rounded corner at the right angle. The angle also defines a recess 110 open in the upstream direction between its two flanges.

The upstream axial end 104*b* of the second part 104 is folded down radially inwards to facilitate gripping of the device 100 when it is to be extracted in the upstream direction, using an appropriate tool.

The inner end 102*b* of the first part 102 is housed in the groove 108 formed on the casing 85, this groove opening up radially outwards and being centred on the axis 3. It is delimited by a bottom 112 at a radial spacing from the inner end 102*b* of the first part 102, so as to enable thermal expansion of this first part. The groove 108 is also delimited by a downstream delimiting surface 108*a* and an upstream delimiting surface 108*b* arranged facing each other in the axial direction.

The first part 102 has a first sealing surface 114 bearing axially against the downstream delimiting surface 108*a* of the groove, to create a seal between the guide 26 and the injector nozzle 82. The first sealing surface 114 corresponds to the downstream surface of the first band shaped part 102. Similarly, the second part 104 has a second sealing surface 116 bearing radially against the inner surface 40 of the guide 26. The second sealing surface 116 corresponds to the radially outer surface of the second band shaped part 104.

When air under pressure output from the compressor unit penetrates into the recess 110 defined by the sealing device 100, the contact forces at the sealing surfaces 114, 116 are reinforced to obtain an even higher performance seal. Furthermore, the device 100 wears earlier than the outer casing 85 of the injector nozzle 82, such that it forms a sacrificial part also acting as a wear indicator. Therefore it is easy to replace it before wear between the guide and the other casing 85 becomes problematic and requires major action. In this respect, note that leak tightness is not affected by wear of the casing 85 at the downstream limitation surface 108*a* of the groove resulting from contact with the device 100. Air pressure in the hollow 110 forces the device 100 into contact with the surface 108*a* of the groove, thus compensating for the wear clearance that might arise between the downstream delimiting surface 108*a* and the first sealing surface 114.

Figure 4:
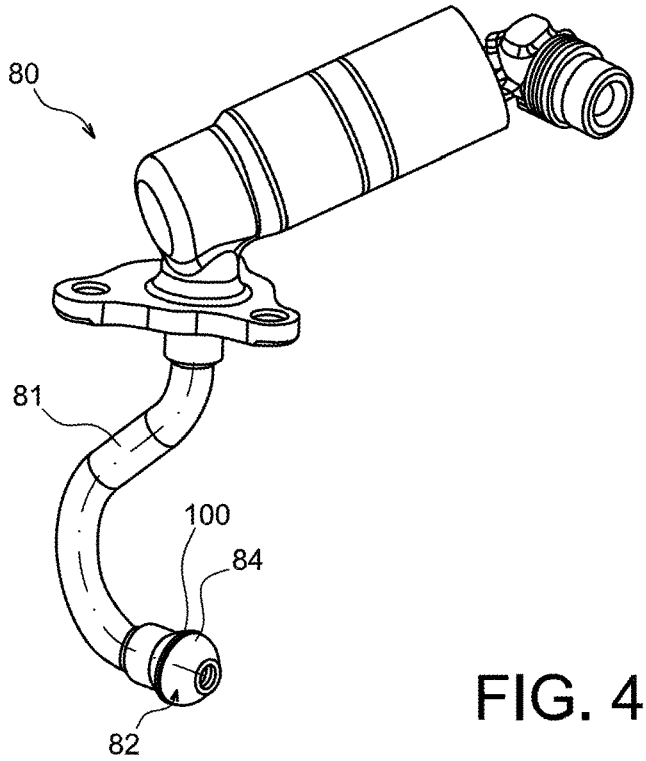
FIG. 4 shows a perspective view of the fuel injector forming an integral part of the arrangement shown on FIGS. 2 and 3.

The first step in assembling the assembly 200 comprising the injector and the injection system is to install the sealing device 100 in the groove formed on the outer casing of the injector nozzle, as shown in FIG. 4. It is put into place by opening the segmented ring 100, and then closing it once it is in position radially facing the groove.

The injector nozzle 82 fitted with the sealing device 100 is then inserted in the centring opening 40', by movement of the nozzle 82 along the direction of its longitudinal axis 3. This insertion is facilitated by the connecting radius 106, that precentres the assembly. Furthermore, the risk that the device 100 should escape from the groove 108 is extremely low because the upstream delimiting surface 108*b* extends radially outwards beyond the inner end 102*b* of the first part 102 of the sealing device 100. During the insertion, the device 100 can then be retained by the stop at this inner end 102*b* in contact with the upstream delimiting surface 108*b* of the groove.

Figure 7A:
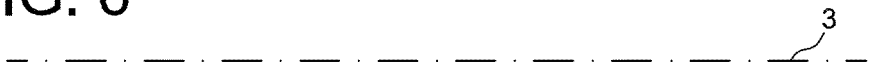
FIG. 7*a* is a perspective view of a first embodiment of the sealing device fitted on the arrangement shown on the previous figures.
Figure 7A:
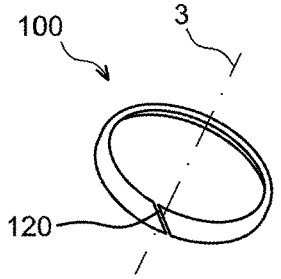
Figure 7B:
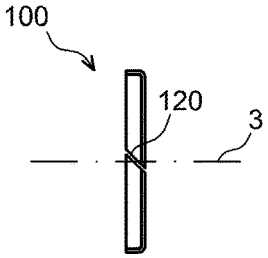
FIG. 7*b* is an elevation view of the view in the previous figure.
Figure 8A:
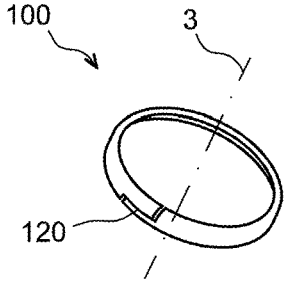
FIG. 8*a* is a perspective view of a second embodiment of the sealing device fitted on the arrangement shown on the previous figures.
Figure 8B:
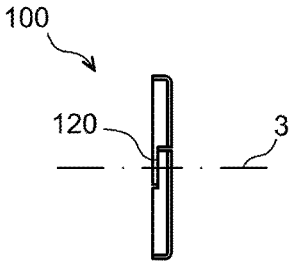
FIG. 8*b* is an elevation view of the view in the previous figure.

A first embodiment of the split ring 100 is now illustrated with reference to FIGS. 7*a* and 7*b*. In this case, the slit 120 in the ring is straight and is inclined relative to an axis 3 of this ring. This causes rotation of the air leak generated by the slit in the ring, the direction of rotation and the angle being chosen so as to blend as well as possible into the air flow in the combustion chamber. According to a second embodiment represented on FIGS. 8*a* and 8*b*, the slit is generally Z-shaped with the central portion of this slit 120 extending circumferentially and corresponding to an axial overlap zone of the two ends of the ring 100.

Obviously, an expert in the subject could make various modifications to the invention that has just been described without going outside the framework of the presentation of the invention.

The invention claimed is:

1. An arrangement for a combustion chamber for an aircraft turbine engine, the arrangement comprising:

a system for injection of an air-fuel mix into the combustion chamber; and a fuel injector comprising an injector nozzle, the system for injection comprising an injector nozzle guide and, downstream said injector nozzle guide, a mixer bowl that is tapered outwardly in a downstream direction, an inner surface of the injector nozzle guide delimits a centering opening in which there is the injector nozzle that is composed of an outer casing centered on a longitudinal axis of the injector nozzle, said outer casing of the injection nozzle having a spherical outer surface, wherein the arrangement further comprises a sealing device between the inner surface of the injector nozzle guide and the outer casing of the injector nozzle, the sealing device comprising:

a first part accommodated in a groove in the outer casing, said groove extending around said longitudinal axis and being delimited partly by a downstream delimiting surface, the first part having a first sealing surface and bearing axially against said downstream delimiting surface of the groove; and a second part having a second sealing surface bearing radially against said inner surface of the injector nozzle guide, said second part extending backwards in an axial direction from said first part, wherein said groove is partly delimited by an upstream delimiting surface facing said downstream delimiting surface, and wherein the upstream delimiting surface extends radially outwards from an inner end of the first part of the sealing device.

2. The arrangement according to claim 1, wherein said first and second parts of the sealing device are arranged to be approximately orthogonal with a connecting radius between the first and second parts of the sealing device, said second part extending backwards in the axial direction from said connecting radius.

3. The arrangement according to claim 2, wherein said second part comprises an upstream axial end and a downstream axial end, the downstream axial end being located at the connecting radius, said upstream axial end being folded radially inwards.

4. The arrangement according to claim 1, wherein said sealing device is in a form of a split ring.

5. The arrangement according to claim 4, wherein a slit in the split ring is straight and is inclined relative to an axis of the split ring.

6. The arrangement according to claim 1, wherein the sealing device is metallic and that a thickness of the sealing device is approximately constant.

7. An aircraft turbine engine comprising at least one arrangement according to claim 1.

8. A method of assembling an arrangement according to claim 1, comprising:

placing the sealing device in the groove formed on the outer casing of the injector nozzle; and inserting the injector nozzle fitted with the sealing device in the centering opening, by movement of the injection nozzle along a direction of the longitudinal axis of the injection nozzle.

9. The arrangement according to claim 1, wherein the injector nozzle guide includes a precentring portion and a centring portion, the precentring portion is tapered inwardly in the downstream direction, the centring portion is directly connected to a downstream end of the precentring portion, and the centring portion includes a cylindrical inner surface that is the inner surface against which the second sealing surface of the second part bears radially against.

* * * * *